US005924719A

United States Patent [19]

Girard

[11] Patent Number: 5,924,719

[45] Date of Patent: Jul. 20, 1999

[54] APPARATUS FOR ATTACHING A GLIDING ELEMENT TO A SHOE

[75] Inventor: François Girard, Veyrier Du Lac, France

[73] Assignee: Salomon S.A., Metz-Tessy, France

[21] Appl. No.: 09/014,248

[22] Filed: Jan. 27, 1998

Related U.S. Application Data

[63] Continuation of application No. 08/426,868, Apr. 24, 1995, abandoned.

[30] Foreign Application Priority Data

Apr. 29, 1994 [FR] France ..... 94.05406

[51] Int. Cl.[6] ..... A63C 9/18

[52] U.S. Cl. ..... 280/615; 280/613

[58] Field of Search ..... 280/614, 615, 280/600, 613, 625, 631, 632

[56] References Cited

U.S. PATENT DOCUMENTS

| | | | |
|---|---|---|---|
| 2,172,669 | 9/1939 | Taft | 280/614 |
| 4,273,355 | 6/1981 | Storandt | 280/614 |
| 4,659,103 | 4/1987 | Tessaro | 280/615 |
| 4,802,687 | 2/1989 | Shimizu | 280/615 |
| 4,836,572 | 6/1989 | Pozzobon | 280/613 |
| 5,207,446 | 5/1993 | Arnulf et al. | 280/615 |
| 5,213,359 | 5/1993 | Girard | 280/615 |
| 5,671,941 | 9/1997 | Girard | 280/615 |

FOREIGN PATENT DOCUMENTS

| | | | |
|---|---|---|---|
| 0243847 | 11/1987 | European Pat. Off. | A63C 9/20 |
| 2537010 | 6/1984 | France | A63C 9/00 |
| 2595952 | 9/1987 | France | A63C 11/00 |
| 2642980 | 8/1990 | France | A63C 9/00 |
| 2662090 | 11/1991 | France | A63C 5/00 |
| 3935202 | 5/1990 | Germany | 280/615 |

*Primary Examiner*—Robert J. Oberleitner
*Assistant Examiner*—Michael Mar
*Attorney, Agent, or Firm*—Greenblum & Bernstein, P.L.C.

[57] ABSTRACT

An apparatus for attaching a shoe to a gliding element. The apparatus includes a blocking/anchoring mechanism of the shoe in an anchoring zone thereof extending substantially from the front end of the shoe to the area of the metatarso-phalangian journal zone or in front thereof. The apparatus includes an arrangement for rocking the blocking/anchoring mechanism, this rocking arrangement being positioned in the anchoring zone of the shoe and being designed so as to allow for a predetermined angle of movement of the shoe assembly with respect to the gliding element. Preferably, the maximum angle of movement of the blocking/anchoring mechanism is between about 5° and 30°.

28 Claims, 2 Drawing Sheets

APPARATUS FOR ATTACHING A GLIDING ELEMENT TO A SHOE

CROSS-REFERENCE TO RELATED APPLICATIONS

This application is a continuation of application Ser. No. 08/426,868, filed on Apr. 24, 1995, now abandoned, the disclosure of which is hereby incorporated by reference thereto in its entirety and the priority of which is claimed under 35 USC 120. This application is also based upon French application No. 94 05406, filed on Apr. 29, 1994, the disclosure of which is hereby incorporated by reference thereto in its entirety and priority of which is hereby claimed under 35 USC 119.

BACKGROUND OF THE INVENTION

1. Field of the Invention

The present invention relates to an apparatus for attaching a shoe to a gliding element such as a cross-country ski adapted, more particularly, for the practice of skating or skating steps, but also to any other gliding element allowing for the practice of a gliding sport of the skating or ice skating type.

It is more specifically related to an attachment apparatus in which the shoe is affixed to the gliding element at least in the area of the metatarso-phalangian zone or of the protuberance of the large toe.

2. Description of Background and Relevant Information

French Patent Publication No. 2,642,980, discloses a multi-point attachment apparatus for a cross-country ski constituted by a beam journalled on the ski, on which the shoe is anchored from the front end thereof up to a zone located in front of the metatarso-phalangian journal axis. Such an apparatus ensures, by means of the beam, a linkage that is journalled, but rigid in the transverse direction, from the shoe to the ski, and more particularly adapted for the practice of mountain skiing.

Furthermore, it is provided in this same patent publication to affix the beam to the ski and only allow rotation of the shoe about a single axis of rotation positioned in front of the shoe, with the aim of practicing cross country skiing itself, whether it is the classic technique or skating. Such a multi-point attachment apparatus has proven unfortunately to be of a too complicated, heavy and costly construction. It is not very adapted for the practice of skating which requires a good control of the ski by the shoe.

It has likewise been proposed, for the practice of step skating in cross-country skiing or skating, special attachment apparatus maintaining the entire front zone of the shoe up to the metatarso-phalangeal journal axis.

Such an attachment apparatus is for example described in commonly owned French Patent Publication No. 2,595,952. Such an attachment system with an engagement of the shoe on the ski over the entire front zone until the area of the metatarso-phalangeal journal axis is particularly adapted to the practice of skating. Indeed, it provides a better guidance of the ski and a better stability, an increased precision, as well as a good ski/shoe contact, and thus a good feel of the snow necessary for the practice of skating.

Nevertheless, the disadvantage of such an attachment apparatus is the absence of angular movement between the foot and the ski or the gliding element, the foot being connected by the attachment of the shoe until the area of the metatarsus.

Indeed, certain skating skiers prefer to have a greater angular movement so as to have as long a gliding phase as possible and subsequently a greater impulse. The same desire is true for other types of skating sports.

SUMMARY OF THE INVENTION

An object of the present invention is thus to provide an improved apparatus for attaching a gliding element of the skating type, and by reconciling the two contradictory requirements, to assure an engagement of the shoe up to the area of the metatarsus, while allowing for a sufficient angular movement between the shoe and the gliding element.

This object is achieved in the apparatus according to the invention which is of the type comprising an attachment or blocking/anchoring mechanism of the shoe in an attachment or anchoring zone thereof extending substantially from the front end of the shoe up to the area of the metatarso-phalangeal journal zone or in front thereof, whereby it comprises a device for rocking the attachment mechanism, this rocking device being positioned in the attachment zone of the shoe, the rocking device being designed so as to allow for a predetermined angle of movement of the shoe assembly with respect to the gliding element.

In this manner, even though the shoe is maintained over its entire front zone substantially to the area of the metatarsus, one possibility of supplemental movement of the foot with respect to the gliding element is offered. As a result the gliding phase can be continued longer and the impulse is improved.

According to an advantageous embodiment, the maximum angle of rotation of the attachment mechanism is between 5 and 30 degrees. Such an arrangement limits the inherent play to rocking the attachment mechanism and makes it possible to guarantee the guidance and stability necessary for the practice of skating.

When the attachment mechanism of the shoe is constituted by a journalled latching of the hinge type, it is advantageous that the axis of the latching system likewise be the pivot axis of the attachment mechanism assembly.

BRIEF DESCRIPTION OF THE DRAWINGS

The invention will be better understood and the characteristics thereof will become clearer by means of the following description with reference to the annexed schematic drawings in which.

A DETAILED DESCRIPTION OF THE INVENTION

Figure 1:
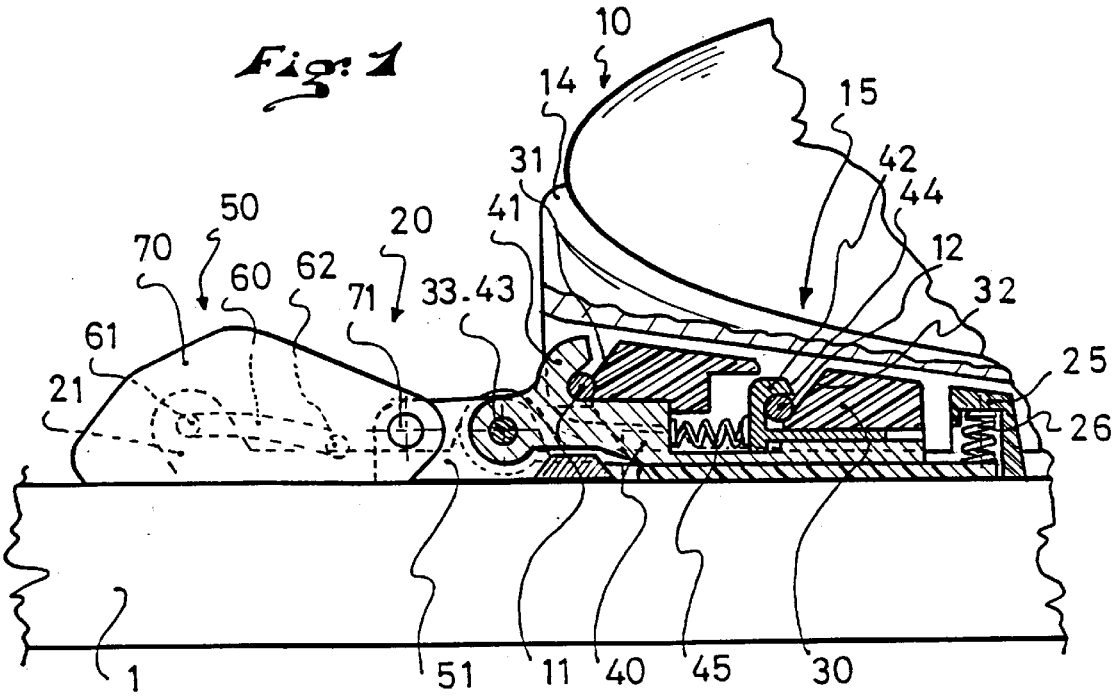
FIG. 1 is a partial longitudinal cross sectional view of the attachment apparatus according to the invention with an associated cross country ski shoe.
Figure 2:
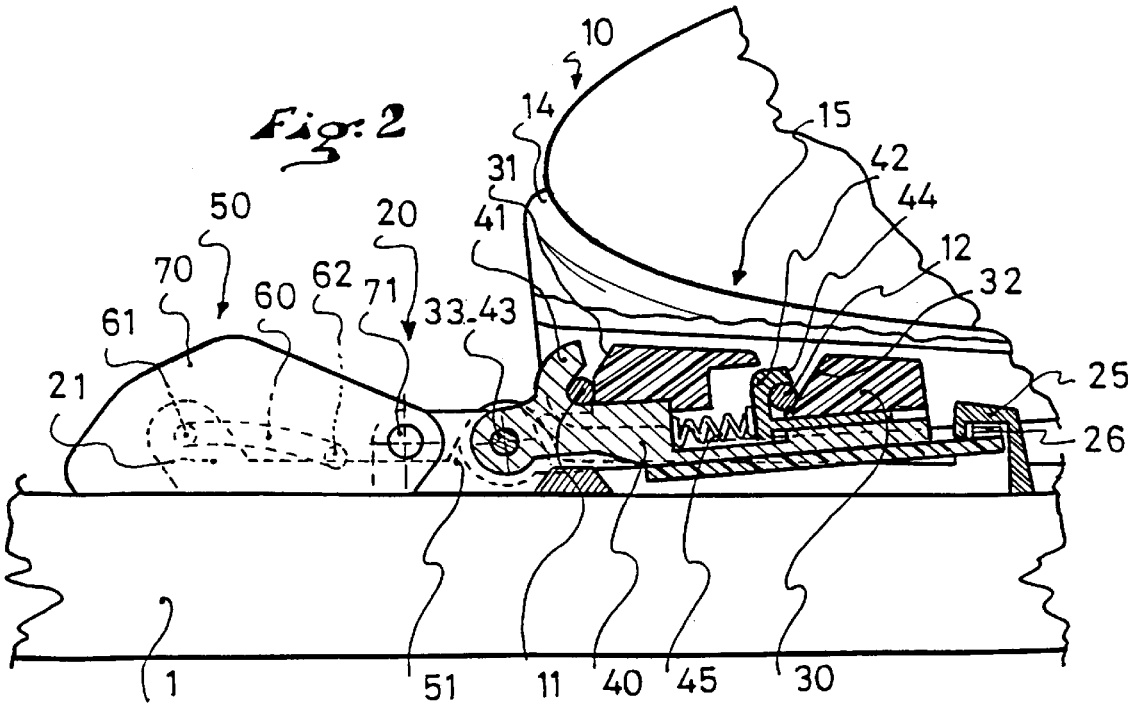
FIG. 2 is view similar to FIG. 1 showing the possible angle of movement.

FIGS. 1 and 2 illustrate the application of the invention to the latching, on a gliding element for the practice of skating, of a shoe having two anchoring pins or axles 11 and 12, one of the pins 11 being situated at the front end of the shoe, and the second pin 12 being situated substantially in the area of the metatarso-phalangeal journal zone or in front thereof.

A preferred position of the pin 12 is between 30 and 60 millimeters to the rear of the front surface 14 of the shoe.

These two pins 11 and 12 define the attachment or blocking/anchoring zone 15 of the shoe.

The attachment apparatus 20 is essentially constituted of a base 21 adapted to be affixed to the ski 1, a beam or member 30 journalled on the base 21 about a pivot or angular movement structure including, for example, the transverse axis 33, a latching carrier 40 mounted longitudinally displaceably mounted within the beam 30 and a knuckle joint latching system 50 of a type known per se. Alternatively, the attachment apparatus 20 can be considered to include an attachment mechanism, which includes those structural elements which are effective for latching or securing the shoe to the ski and a pivot or angular movement structure which are effective for providing a pivot or angular movement connection for the attachment mechanism with respect to the ski.

The knuckle joint locking or latching system is constituted by a slide 51 which is displaceable in the longitudinal direction of the ski, along a slideway which is not shown in the drawings, which is journalled at 43 on the carrier 40.

Slide 51 is maintained in the latched position of the shoe by a U-shaped wire spring 60 journalled, on the one hand, on one fixed portion of base 21 of the apparatus through median portion 61 and, on the other hand, at each of its ends 62 on an unlatching lever 70 in the form of a cap which is itself journalled at 71 on slide 51.

The assembly 51, 60, 70 constitutes a knuckle joint system whose axes are constituted by the axes 61, 62 and 71, the two axes 61, 71 defining the dead point line of the knuckle joint.

In a manner known in itself, the locking of the knuckle joint is obtained when the journal axis defined by 62 passes below the dead point line defined by axes 61 and 71.

The latching of the system is obtained by rearward displacement, i.e., towards the right on the drawing, of the slide 51, the sleeve driving the latching carrier 40 in its displacement in this direction.

Conversely, the unlatching or unlocking is obtained by pivoting of the unlatching lever 70 in the clockwise direction, about its axis 71, this displacement driving the gliding towards the front of slide 51, and consequently of the latching carrier 40.

The latching carrier 40 comprises two latches or hooks 41 and 42 having substantially the form of a C open towards the rear.

Each of hooks 41 and 42 cooperates in the manner of a jaw/counterjaw with a support surface affixed with a respectively affixed support surface 31 and 32 for the latching of a respectively associated pin or axle 11 and 12 of the shoe.

As seen in the figures, the support surface 31 has a vertical portion that engages pin 11 while the support surface 32 has a slight slope, so as to allow for the release as will be seen below. These two support surfaces 31 and 32 are provided on member 30 journalled on base 21. Hook 42 likewise comprises a slight ramp 44 forming with the support surface 32 a sort of V allowing for automatic insertion of the shoe.

Hook 41 is affixed to the latching carrier 40, while hook 42 is displaceably mounted in the longitudinal direction on carrier 40.

A spring 45 constantly biases hook 42 towards the rear of the attachment, i.e., in the direction of support surface 32, in the latching position of pin 12.

Consequently, in case of an excessive force exerted on the pin 12, the latter can glide upwardly along the ramp 32 by pushing movable hook 42 back towards the front against the force of spring 45, until being freed from its seat, while the shoe is retained at the front by means of the pin 11 being retained against such automatic release from hook 41. Thus, the blocking/anchoring mechanism includes an automatic releaseable latching device, in which pin 12 is latched, located at the rear end of the anchoring zone, and a second latching device operative to latch pin 11 at the front end of the shoe in which the pin cannot be automatically released.

Conversely, this construction likewise allows for an automatic insertion of the pin 12 with the aid of the V for the shoe insertion constituted by the ramps 44 and 32, the pin 12 pushing hook 42 against the action of spring 45.

An abutment 25 affixed to base 21 is furthermore provided to limit the upward pivoting of the journalled member 30. A spring 26 interposed between the member 30 and this abutment biases furthermore the member 30 downwardly, into a "null" rotational position shown in FIG. 1. The abutment 25 functions as an engagement structure, which can be considered to be a part of the attachment mechanism, which effectively secures the shoe to the ski along the entirety of the aforementioned attachment zone.

Axes 33 and 43 are positioned so as to coincide in the latching position of carrier 40, so as to allow for a simultaneous rotation of member 30 and of carrier 40 about their common axis 33 and 43 in this latching position.

As is shown clearly by comparison of FIGS. 1 and 2, the attachment apparatus constituted by carrier 40 and member 30 can pivot upwardly and thus assure to the shoe assembly a supplemental angular movement adapted to extend the gliding phase. It will be noted that this constitutes a real angular movement of the assembly of the shoe with respect to the ski which thus achieves a real compromise between an engagement over an entire front zone of the shoe as known from French Patent Publication No. 2,595,952 and a total journal detrimental to a good guidance, of the shoe on the ski as in French Patent Publication No. 2,642,980.

Abutment 25 which limits the path of the journalled member 30 is selected so as to allow for a maximum rotation angle between about 5° and 30°, and preferably between about 10° and 20°.

The journal axes 33 and 43 can be displaced towards the rear until a position corresponding to that of pin 12.

The embodiment shown in FIG. 3 will next be described.

In this case, the attachment apparatus 120 has exactly the same type of construction, i.e., a fixed base 121, a pivot structure for journalling a member 130 on the base about an axis 133, a latching carrier 140 longitudinally displaceably mounted with respect to the member 130 and whose displacement is controlled by a slide 151, itself controlled by a knuckle joint latching system 160, 170.

Although having different shapes by virtue of the position of the rotational axes 133 and 143, the elements having the same function are thus designated by identical reference numerals increased by 100.

The main difference resides in this position of the journal axis 133, 143, common to the beam 130 and to the latching carrier 140, in the area of the rear end of the anchoring or attachment zone, a position which makes it possible in particular to have a greater angle of movement.

Figure 3:
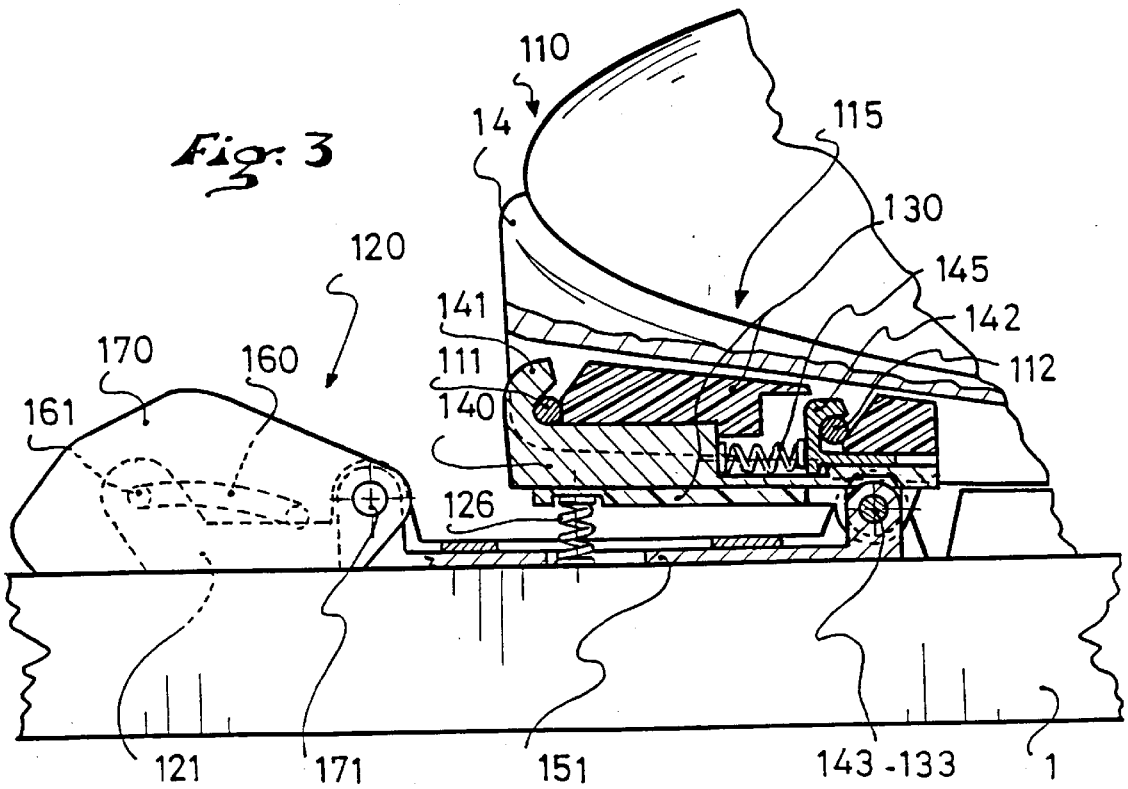
FIG. 3 is view similar to FIG. 1 of an attachment apparatus according to another embodiment.

In this embodiment, the abutment or engagement structure limiting the angular movement is constituted by the upper surface of the ski 1 or of base 121, and the "null" rotational position is that which is shown in FIG. 3 where the spring 126 located at the front of the attachment apparatus biases the journalled member 130 upwardly.

Depending upon the result desired, it is possible to displace the journal axis of the member 130 in any intermediate position between the front end 14 of the shoe and the rear limit of the attachment or blocking/anchoring zone 115 of the shoe.

Such a journal axis can in particular be arranged in a median position with respect to the two ends of such a zone. It can likewise be blended with one of the latching axis of the attachment apparatus.

Figure 4:
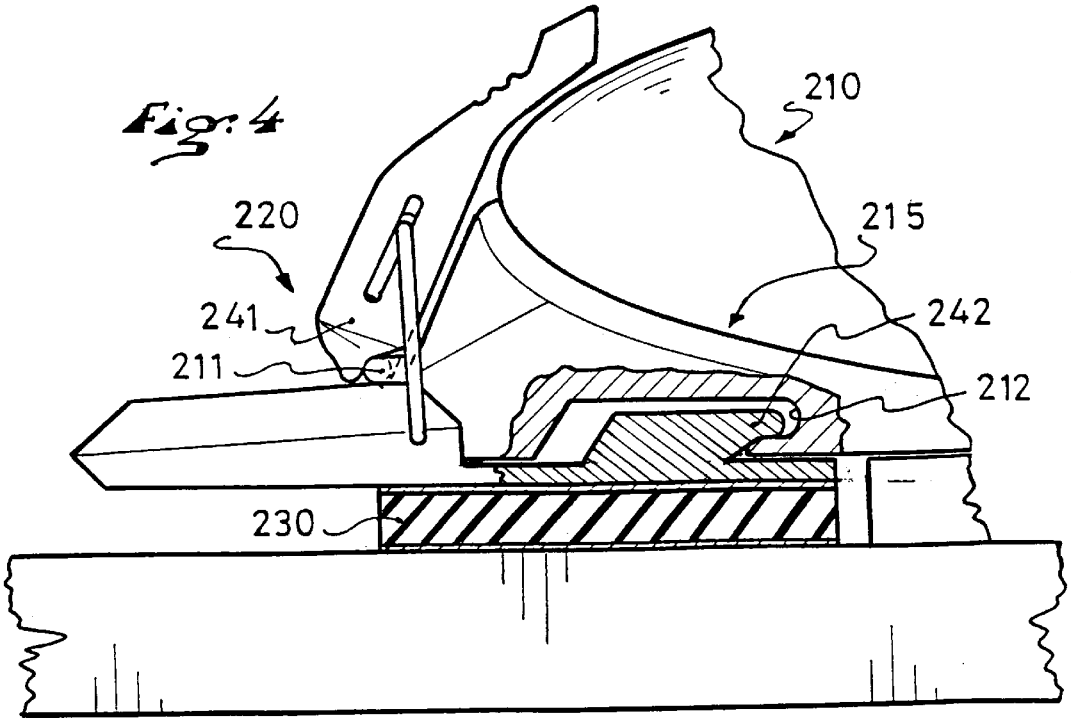
FIG. 4 is a view similar to FIG. 1 of an attachment apparatus according to yet another embodiment.

FIG. 4 illustrates a simplified embodiment in which the shoe is maintained not by means of latching axes, but rather by means of a latching projection 242 extending towards the rear and cooperating with an associated recess 212 of the shoe and of a hooking or latching system 241 of a type known in itself cooperating with a hooking buckle 211 of the shoe.

The attachment zone 215 of the shoe is thus demarcated, at the front, by the buckle 211 and at the rear by the recess 212.

In this case, the pivotal or angular movement of the blocking/anchoring mechanism 211, 212, 241, 242 is obtained by simple interposition of a layer of elastic material 230 between the upper surface of the ski 1 and the blocking/anchoring mechanism, whereby the member 242 effectively pivots at the rear end of the recess 212, the front end of the member 242 being movable toward and away from the ski 1.

Such a layer can be constituted out of any known elastic material. Preferably, the layer of elastic material will have a thickness between about 10 and 20 millimeters.

An abutment or engagement structure (not shown in the drawing) can be provided to prevent any displacement of this elastic layer in the transverse direction. The aforementioned abutment or engagement structure, limiting the pivoting of the attachment mechanism of the FIG. 4 embodiment, is constituted by either by the upper surface of the ski 1 or of a base (not shown), or merely the full compression of the elastic layer 230.

Such a solution is particularly desirable in the case where a small angle of movement is desired.

The invention is not to be considered as being limited to the disclosed embodiments of the invention. In this regard, the invention can be utilized for the linkage of a shoe with any gliding element of the skating type, ice skating, in line roller skating, ski skating, etc.

Further, the invention is not limited to the particular materials and shapes disclosed except when specifically necessary to accomplish the objects of the invention. Although particular materials are disclosed, the invention is not limited to these materials and other materials useful in achieving the aims of the invention may likewise be used.

What is claimed is:

1. An apparatus adapted to be affixed to a gliding element and for attaching a shoe to the gliding element for the practice of a gliding/skating sport in which a heel of the shoe is permitted to be raised and lowered with respect to the gliding element, said apparatus comprising:

an attachment mechanism adapted to be attached to the shoe along a longitudinally extending attachment zone of the shoe, to thereby attach the shoe to the gliding element along the attachment zone of the shoe, said attachment zone extending substantially from a front end of the shoe substantially to an area of a metatarsophallangian zone of the user's foot;

an angular movement structure positioned substantially in said attachment zone to affix said attachment mechanism to the gliding element at a predetermined area at one of (1) a front portion of said attachment zone and (2) a rear portion of said attachment zone for angular movement of said attachment mechanism relative to the gliding element during gliding, said angular movement structure composing an elastic biasing element to bias said attachment mechanism to a "null" rotational position; and an engagement structure having at least a portion spaced from said predetermined area, along said attachment zone, for effective engagement with said attachment mechanism and for limiting said angular movement of said attachment mechanism, said angular movement structure thereby providing a predetermined extent of angular movement of the shoe with respect to the gliding element during the practice of the gliding/skating sport, said engagement structure being located beneath a lower portion of the shoe at one of (1) a position rearward of said front portion of said attachment zone and (2) a position forward of said rear portion of said attachment zone.

2. An apparatus according to claim 1, wherein:

said engagement structure is positioned for limiting said predetermined extent of angular movement to between 5° and 30°.

3. An apparatus according to claim 1, wherein:

said angular movement structure comprises a journal for pivoting of said attachment mechanism, said journal being located in said attachment zone of the shoe; and said engagement structure is positioned to limit said angular movement of said attachment mechanism to said predetermined extent.

4. An apparatus according to claim 3, wherein:

said apparatus further comprises a base; and said attachment mechanism comprises at least one latching device for latching the shoe to the gliding element, said latching device being hinged to said base about said journal.

5. An apparatus according to claim 3, wherein:

said angular movement structure comprises a member mounted about said journal; and said attachment mechanism is mounted upon said journalled member.

6. An apparatus according to claim 1, wherein:

said attachment mechanism comprises a releasable latching device located at a rear end of said attachment zone, said releasable latching device being operative to automatically release the shoe.

7. An apparatus according to claim 6, wherein:

said attachment mechanism further comprises a second latching device, said second latching device comprises a device latching the front end of the shoe against automatic release.

8. An apparatus according to claim 7, wherein:

said apparatus further comprises a base; and said releasable latching device and said second latching device are hinged to said base about a common journal.

9. An apparatus according to claim 1, wherein:

said angular movement structure comprises a layer of elastic material positioned beneath said attachment mechanism and adapted to be supported upon the gliding element.

10. An apparatus according to claim 9, wherein:

said layer of elastic material has a thickness between about 10 millimeters and 20 millimeters.

11. An apparatus according to claim 1, wherein:

said attachment zone extends from the front end of the shoe to a position approximately 30 to 60 millimeters rearward of the front end of the shoe.

12. An apparatus according to claim 1, in combination with the shoe.

13. An apparatus according to claim 7, in combination with the shoe, said shoe comprising a first transverse pin for being engaged by said releasable latching device at the rear end of said attachment zone, and a second transverse pin for being engaged by said second latching device at the front end of the shoe.

14. An apparatus according to claim 1, wherein:

said attachment mechanism is positioned for attachment exclusively with shoe structure beneath the user's foot; and said angular movement structure comprises a lower surface having a shape adapted to be affixed to an upper non-recessed surface of the gliding element.

15. An apparatus adapted to be affixed to a gliding element and for attaching a shoe to the gliding element for the practice of a gliding/skating sport in which a heel of the shoe is permitted to be raised and lowered with respect to the gliding element, said apparatus comprising:

an attachment mechanism adapted to be attached to the shoe along a longitudinally extending attachment zone of the shoe, to thereby attach the shoe to the gliding element along the attachment zone of the shoe, said attachment zone extending substantially from a front end of the shoe substantially to an area of a metatarso-phallangian zone of the user's foot;

a pivot structure positioned substantially in said attachment zone to affix said attachment mechanism to the gliding element about a predetermined axis at one of (1) a front portion of said attachment zone and (2) a rear portion of said attachment zone for pivoting during gliding, said pivot structure composing an elastic biasing element to bias said attachment mechanism to a "null" rotational position;

an engagement structure having at least a portion spaced from said predetermined axis along said attachment zone for effective engagement with said attachment mechanism and for limiting pivotal movement of said attachment mechanism about said axis, said pivot structure thereby providing a predetermined extent of angular movement of the shoe with respect to the gliding element during the practice of the gliding/skating sport, said engagement structure being located beneath a lower portion of the shoe at one of (1) a position rearward of said front portion of said attachment zone and (2) a position forward of said rear portion of said attachment zone.

16. An apparatus according to claim 15, wherein:

said engagement structure is positioned for limiting said predetermined extent of angular movement to between 5° and 30°.

17. An apparatus according to claim 15, wherein:

said pivot structure comprises a journal for pivoting of said attachment mechanism, said journal being located in said attachment zone of the shoe; and said engagement structure is positioned to limit said pivoting of said attachment mechanism to said predetermined extent.

18. An apparatus according to claim 17, wherein:

said apparatus further comprises a base; and said attachment mechanism comprises at least one latching device for latching the shoe to the gliding element, said latching device being hinged to said base about said journal.

19. An apparatus according to claim 17, wherein:

said pivot structure comprises a member mounted about said journal; and said attachment mechanism is mounted upon said journalled member.

20. An apparatus according to claim 15, wherein:

said pivot structure comprises a layer of elastic material positioned beneath said attachment mechanism and adapted to be supported upon the gliding element.

21. An apparatus according to claim 20, wherein:

said layer of elastic material has a thickness between about 10 millimeters and 20 millimeters.

22. An apparatus according to claim 15, wherein:

said attachment zone extends from the front end of the shoe to a position approximately 30 to 60 millimeters rearward of the front end of the shoe.

23. An apparatus according to claim 15, wherein:

said predetermined axis of said pivot structure is located at a front portion of said attachment zone and said engagement structure is located rearward of said predetermined axis.

24. An apparatus according to claim 15, wherein:

said predetermined axis of said pivot structure is located at a rear portion of said attachment zone and said engagement structure is located forward of said predetermined axis.

25. An apparatus according to claim 15, wherein:

said attachment mechanism is positioned for attachment exclusively with shoe structure beneath the user's foot; and said angular movement structure comprises a lower surface having a shape adapted to be affixed to an upper non-recessed surface of the gliding element.

26. An apparatus adapted to be affixed to a gliding element and for attaching a shoe to the gliding element for the practice of a gliding/skating sport in which a heel of the shoe is permitted to be raised and lowered with respect to the gliding element, said apparatus comprising:

a first latching mechanism including a first latching element, said first latching mechanism being adapted to be carried by the gliding element and adapted for latching cooperation with a first complementary element borne by the shoe substantially at a metatarso-phallangian zone of the foot;

a second latching mechanism including a second latching element, said second latching mechanism being adapted to be carried by the gliding element and adapted for latching cooperation with a second complementary element borne by the shoe substantially at a front end of the shoe;

where said first latching mechanism and said second latching mechanism attach the shoe to the gliding element along an attachment zone extending substantially from the front end of the shoe substantially to the area of the metatarso-phallangian zone of the foot;

the latching carrier adapted to be pivotally attached to the gliding element at a predeterminate transverse location, said latching carrier carrying said first latching mechanism and said second latching mechanism for enabling pivotal movement of said first latching mechanism and said second latching mechanism; and an engagement structure having at least a portion spaced from said transverse location, along said attachment zone, for effective engagement with said latching carrier beneath a lower portion of the shoe for limiting pivotal movement of said latching carrier and thereby providing a predetermined extent of angular movement of the shoe with respect to the gliding element during the practice of the gliding/skating sport.

27. An apparatus according to claim 26, further comprising:

an elastic device to apply a force to bias said latching carrier toward a neutral position tending to move the rear of the shoe toward the gliding element.

28. An apparatus adapted to be affixed to a gliding element and for attaching a shoe to the gliding element for the practice of a gliding/skating sport in which a heel of the shoe is permitted to be raised and lowered with respect to the gliding element, said apparatus comprising:

a first latching mechanism including a first latching element, said first latching mechanism being adapted to be carried by the gliding element and adapted for latching cooperation with a first complementary element borne by the shoe at a metatarso-phallangian zone of the foot;

a second latching mechanism including a second latching element, said second latching mechanism being adapted to be carried by the gliding element and adapted for latching cooperation with a second complementary element borne by the shoe substantially at a front end of the shoe;

first and second pins attached to the shoe for selective latching engagement with the first and second latching mechanism;

wherein said first latching mechanism and said second latching mechanism attach the shoe to the gliding element along an attachment zone extending substantially from the front end of the shoe substantially to the area of the metatarso-phallangian zone of the foot;

a latching carrier adapted to be pivotally attached to the gliding element at a predeterminate transverse location, said latching carrier carrying said first latching mechanism and said second latching mechanism for enabling pivotal movement of said first latching mechanism and said second latching mechanism;

an engagement structure having at least a portion spaced from said transverse location, along said attachment zone, for effective engagement with one end of said latching carrier beneath a lower portion of the shoe for limiting pivotal movement of said latching carrier and thereby providing a predetermined extent of angular movement of the shoe with respect to the gliding element during the practice of the gliding/skating sport; and an elastic device for biasing the one end of the latching carrier towards the gliding element.

* * * * *